US006578665B1

(12) United States Patent
DeBaca et al.

(10) Patent No.: US 6,578,665 B1
(45) Date of Patent: Jun. 17, 2003

(54) STRUCTURE PROTECTING LADDER STABILIZER

(75) Inventors: Ralph DeBaca, Los Lunas, NM (US); Joe Silva, Sr., Los Lunas, NM (US); Eric E. Eichwald, Los Lunas, NM (US)

(73) Assignee: REJ, LLC, Los Lunas, NM (US)

( * ) Notice: Subject to any disclaimer, the term of this patent is extended or adjusted under 35 U.S.C. 154(b) by 0 days.

(21) Appl. No.: 09/886,573

(22) Filed: Jun. 20, 2001

Related U.S. Application Data

(60) Provisional application No. 60/212,853, filed on Jun. 20, 2000.

(51) Int. Cl.[7] ..... E04G 5/02

(52) U.S. Cl. ..... 182/107; 182/214

(58) Field of Search ..... 182/116, 107, 182/129, 214, 228, 229; 248/48.2, 300

(56) References Cited

U.S. PATENT DOCUMENTS

| | | | | | |
|---|---|---|---|---|---|
| 3,288,249 | A | | 11/1966 | Gibson | 182/214 |
| 4,306,632 | A | | 12/1981 | Brown | 182/214 |
| 4,444,291 | A | | 4/1984 | McPherson | 182/214 |
| 4,932,498 | A | | 6/1990 | Miller | 182/214 |
| 5,215,163 | A | | 6/1993 | Kent, Sr. et al. | 182/229 |
| 5,242,031 | A | * | 9/1993 | Ashley | 182/214 |
| 5,358,071 | A | | 10/1994 | Stennett | 182/214 |
| 5,497,848 | A | * | 3/1996 | Travis | 182/107 |
| 5,509,500 | A | * | 4/1996 | Delagera | 182/107 |
| 5,664,643 | A | * | 9/1997 | Taylor, Jr. | 182/214 |
| 5,743,356 | A | * | 4/1998 | Mitchell | 182/214 |
| 5,855,252 | A | * | 1/1999 | Vrolyks | 182/214 |
| 5,899,296 | A | * | 5/1999 | Lantz | 182/214 |
| 5,971,100 | A | | 10/1999 | DeLeon et al. | 182/107 |
| 6,009,974 | A | * | 1/2000 | Jones | 182/107 |
| 6,019,191 | A | | 2/2000 | Flores | 182/214 |
| 6,029,774 | A | | 2/2000 | Cothern | 182/107 |
| 6,244,551 | B1 | * | 6/2001 | Fletcher | 248/238 |
| 6,354,401 | B2 | * | 3/2002 | Murray | 182/214 |

FOREIGN PATENT DOCUMENTS

| | | | | |
|---|---|---|---|---|
| FR | 2705398 | * | 11/1994 | 182/107 |

* cited by examiner

*Primary Examiner*—Bruce A. Lev
(74) *Attorney, Agent, or Firm*—Andrea L. Mays; Jeffrey D. Myers; Peacock, Myers & Adams, PC

(57) ABSTRACT

A ladder stabilizer for supporting a ladder against a structure and protecting surface features of the structure. Two stops 12 prevent the ladder from excessive lateral movement. A support bar 16 affixed to and extending between the stops provides support for the ladder. A mounting bracket 14 attached to each stop 12 is attached either directly to a structure surface, or to a U-shaped bracket 24 that fits around a rain gutter. Each U-shaped bracket fits over or under the rain gutter and is attached to a structure surface. In a second embodiment two support legs 118 bent at obtuse angles in two locations comprise an attachment portion 106 for attaching to the roof of a structure, a ramped portion 116 for extending beyond the roof eave, and a stop portion 114 for preventing excessive lateral movement of the ladder. A support bar 102 is affixed to and extends between the stop portions for supporting the ladder.

8 Claims, 7 Drawing Sheets

STRUCTURE PROTECTING LADDER STABILIZER

CROSS-REFERENCE TO RELATED APPLICATIONS

This application claims the benefit of the filing of U.S. Provisional Patent Application Ser. No. 60/212,853, entitled "Ladder Holder", filed on Jun. 20, 2000, and the specification thereof is incorporated herein by reference.

BACKGROUND OF THE INVENTION

1. Field of the Invention (Technical Field)

The present invention relates to a ladder stabilizing device for attachment to a structure, such as a building, residential home, or the like, for stabilizing the upper end portion of a ladder and preventing damage to structure fascia when the ladder is leaned against the structure for support.

2. Background Art

To perform work on upper out-of-reach surfaces of structures, it is typical to position a ladder against or near the structure to gain access to work surfaces. Roofs of residential homes and other buildings are often inaccessible by stepladders or other means, requiring a ladder to be leaned against the side of the structure for a degree of support that allows the user to climb the ladder and gain access to upper portions of the structure. When supporting ladders against structures, a problem is often encountered when the structure incorporates eaves troughs or rain gutters near the eave of the roof. If the ladder is placed directly against the eaves trough or other rain guttering apparatus, damage or deformity can result due to the relatively weak material, such as aluminum or vinyl, that these apparatuses are typically made from. A further difficulty encountered in leaning the upper end portion of a ladder against such an apparatus is that the apparatus does not provide sufficient support and presents potential safety problems. In addition to damaging eaves troughs, a ladder leaned against a structure can tear roof shingles, break clay roof tiles, deform tin roofs, bend siding, damage stucco, or scratch other types of surface features of a structure. This damage results from the force of the ladder resting against the structure, as well as from the force of the user's weight when climbing upon the ladder. Additionally, ladders that are leaned against a structure tend to shift from side to side, causing the user to feel insecure. The ladder may also translate laterally to such an extent that it falls to one side or the other.

Ladder rail and ladder rung stabilizing devices for securing an upper end portion of a ladder to a structure against which the ladder is leaned are described in patents including U.S. Pat. No. 4,444,291 to McPherson, entitled Ladder Accessory; U.S. Pat. No. 4,306,632 to Brown, entitled Ladder Support; U.S. Pat. No. 5,358,071 to Stennett, entitled Gutter Protecting Ladder Attachment; U.S. Pat. No. 3,288,249 to Gibson, entitled Gutter Bridging Ladder Attachment; U.S. Pat. No. 4,932,498 to Miller, entitled Gutter Guard; U.S. Pat. No. 5,215,163 to Kent, Sr. et al., entitled Ladder Support; U.S. Pat. No. 6,019,191 to Flores, entitled Ladder Support System; U.S. Pat. No. 5,971,100 to DeLeon et al., entitled Ladder Mount and Gutter Saver, and U.S. Pat. No. 6,029,774 to Cothern, entitled Ladder Stabilizing Assembly.

The devices disclosed in these patents are presumably adequate for the specific purposes for which they were designed; however, further improvements are needed. Many of the prior art ladder support devices are unduly awkward and cumbersome. Installing these devices is complex and time-consuming. Several of these devices require being directly affixed to the ladder rails or rungs, rather than providing a simple leaning surface for the ladder. Further, these prior art devices are not flexible for attachment to a variety of structures. A simple, flexible ladder stabilizer is needed that can be firmly secured to a variety of structures, that can protect surface features of the structure and avoid contact with rain guttering apparatuses. The stabilizer should also prevent excessive lateral motion of the ladder to improve ladder safety. An ideal ladder stabilizer would not require attachment to the ladder rails or rungs. Such a ladder stabilizer would be simple, without cumbersome moving parts, easy to manufacture, and inexpensive.

SUMMARY OF THE INVENTION (DISCLOSURE OF THE INVENTION)

The present invention is a ladder stabilizer for supporting a ladder against a structure and for protecting the structure from damage or deformity due to the ladder being supported by the structure. In a first embodiment, the ladder stabilizer comprises two lateral translation stops that prevent lateral movement of the ladder rails; a support bar affixed to and extending between the two stops for supporting an end of the ladder; and square mounting brackets for mounting the stops and support bar either directly and flush against a structure surface or to optional U-shaped rain gutter brackets if the structure has rain gutters. The U-shaped brackets fit around, either over or under, the rain gutter to avoid damaging or deforming the rain gutter when attaching the ladder stabilizer to a structure. In a second embodiment of the invention, two support legs are bent at two angles in two locations to create an attachment portion that is attached to the roof of a structure; a ramped portion for extending upward and away from the roof eave; and a stop portion for preventing excessive lateral movement of the ladder. A transverse support bar is affixed to and extends between the left and rights stops of the two support legs and is used to support an upper end of the ladder to be leaned against a structure.

A primary object of the present invention is to provide a flexible and highly stable device that prevents destructive contact between a ladder and a structure, prevents excessive lateral motion of the ladder, and provides support for the ladder from the structure.

Another primary object of the present invention is to provide a ladder stabilizing device that does not require special means of attachment to the ladder rails or rungs.

Yet another primary object of the present invention is to provide a simple ladder stabilizing device that can be readily altered to be secured flush to structure fascia, over rain guttering, or under rain guttering.

Still another primary object of the present invention is to provide a ladder stabilizing device that is comprised of a minimal number of parts, is easily installed, easily manufactured, and inexpensive.

A primary advantage of the present invention is that optional U-shaped rain gutter brackets can be removed from the ladder stabilizing device if the structure does not contain a rain gutter.

Another primary advantage of the present invention is that the optional U-shaped rain gutter brackets can be attached to the ladder stabilizer to fit either over or under the rain gutter of a structure.

Yet another primary advantage of the present invention is that the surface features of a structure are protected from damage or deformity when a ladder is supported against the structure.

Still another primary advantage of the present invention is that the ladder is supported in a stable vertical position and is prevented from excessive lateral movement by stops on the ladder stabilizer.

Still yet another primary advantage of the present invention is that it is simple, is comprised of a minimal number of parts, is easily manufactured, is relatively inexpensive, and is efficiently installed on a structure.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DESCRIPTION OF THE PREFERRED EMBODIMENTS (BEST MODES FOR CARRYING OUT THE INVENTION)

The present invention for a ladder stabilizer addresses the problems presented by prior art ladder support devices that are designed to be attached to a structure for stabilizing a ladder. The present invention for a ladder stabilizer supports the ladder in a vertical position and protects the structure from the forces of the ladder leaning against the structure, thereby inhibiting deformed or damaged eaves troughs, roofing, siding, stucco, or other structure surface features.

It is to be understood that the term "rain gutter" as used herein is meant to describe various forms of troughs, channels, or the like used along or under the eaves of a roof to carry off rainwater.

Figure 1:
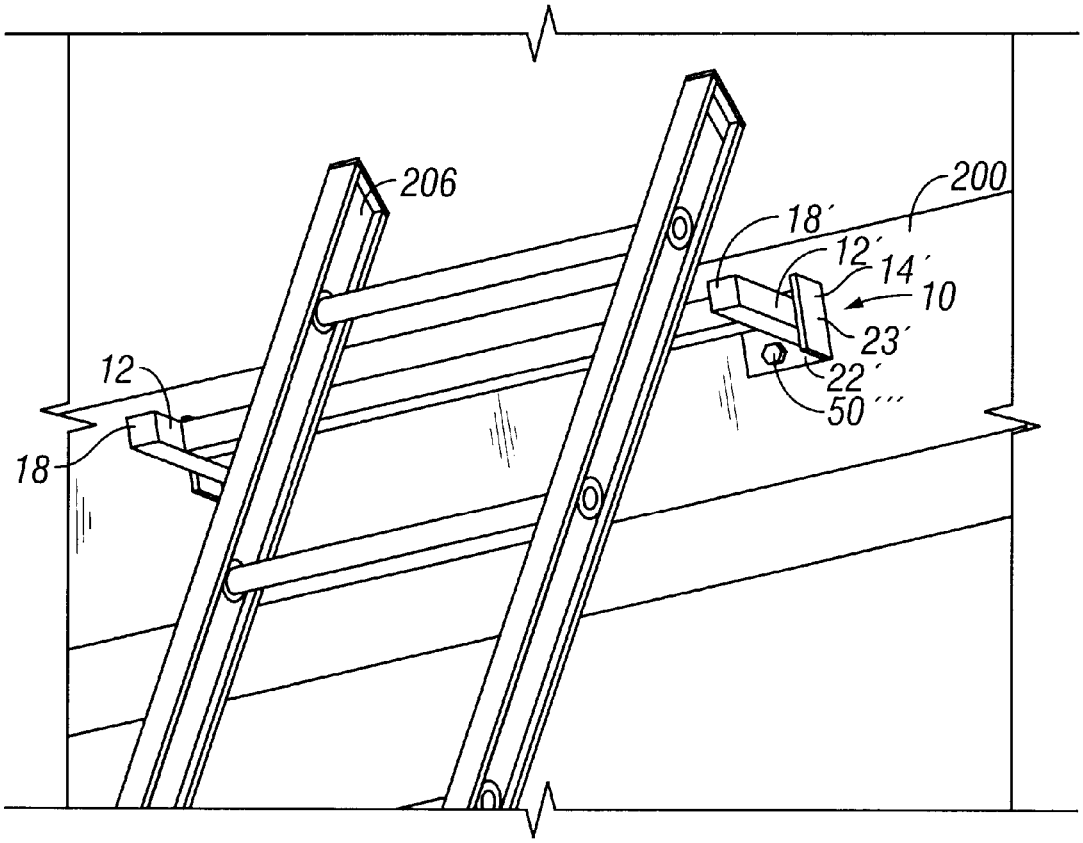
FIG. 1 is a perspective view showing the first embodiment of the ladder stabilizer attached directly to and flush with structure fascia without a rain gutter.
Figure 2:
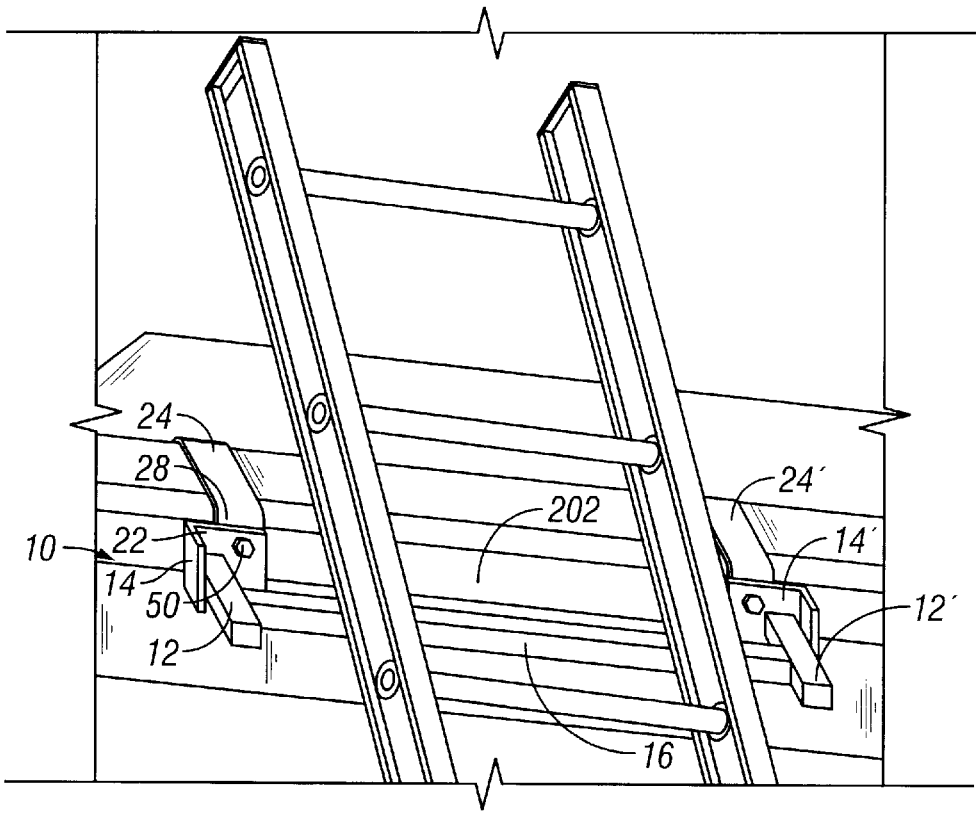
FIG. 2 is a perspective view of the first embodiment of the ladder stabilizer with optional U-shaped rain gutter brackets attached to the structure fascia around a rain gutter.

Referring to FIGS. 1–10, the first embodiment of the present invention for a ladder stabilizer 10 is shown. Attention is turned first to FIGS. 1 and 2, showing ladder stabilizer 10 attached directly to structure fascia (FIG. 1), and attached to structure fascia around a rain gutter (FIG. 2), for a general description of ladder stabilizer 10. Ladder stabilizer 10 comprises a support bar 16 against which a ladder 206 is leaned. A pair of left and right lateral translation stops 12 and 12' that are arranged orthogonally to support bar 16, retain ladder 206 in a substantially vertical position and prevent excessive lateral movement of ladder 206 to the left or right beyond stops 12 and 12'. Support bar 16 is affixed to and extends between stops 12 and 12'. Support bar is affixed to stops 12 and 12' in a secure manner such as welding or by fastening means, such as bolts and nuts, as will be described further below. A pair of mounting brackets 14 and 14' are attached to stops 12 and 12' for mounting ladder stabilizer 10 either directly to structure fascia as shown in FIG. 1, or to optional U-shaped rain gutter brackets 24 and 24' which fit around a rain gutter 202 of a structure and attach to structure fascia as shown in FIG. 2.

Figure 3:
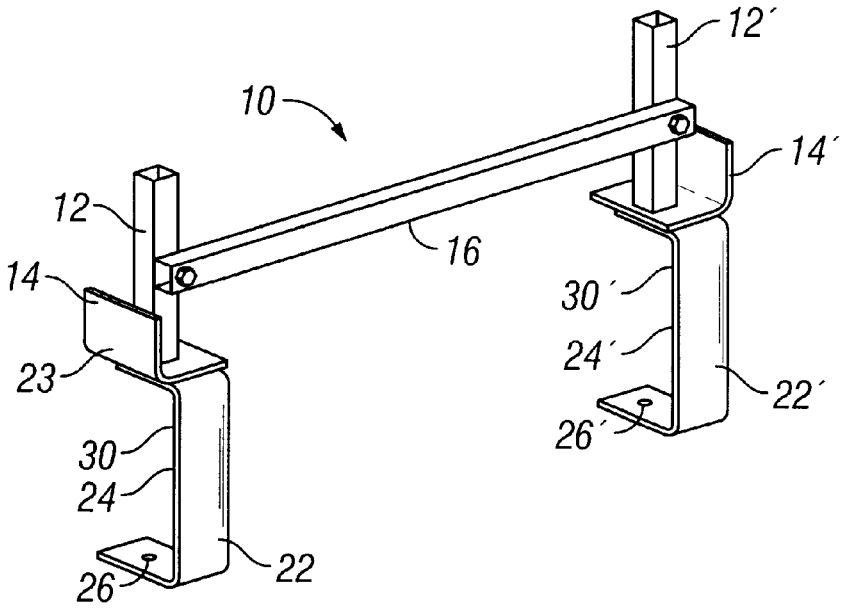
FIG. 3 is perspective view of the first embodiment of the ladder stabilizer with optional U-shaped rain gutter brackets for attachment to a structure around a rain gutter.
Figure 4:
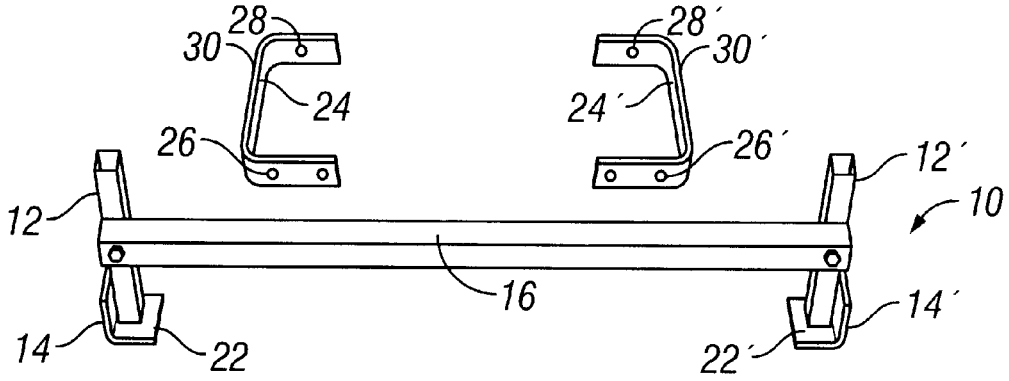
FIG. 4 is a top perspective view of the first embodiment of the ladder stabilizer with optional U-shaped rain gutter brackets detached.

Referring to FIG. 3, a perspective view of ladder stabilizer 10 is shown with optional rain gutter brackets 24 and 24' that are an approximate U-shape. FIG. 4 also shows a perspective view of ladder stabilizer 10 wherein U-shaped optional rain gutter brackets 24 and 24' are detached from ladder stabilizer 10. FIGS. 3 and 4 demonstrate support bar 16 affixed to stops 12 and 12' by fastening means. Mounting bracket 14 can be seen to comprise a planar side portion 23 attached to a surface of stop 12 and a planar mounting portion 22 that attaches either directly to structure fascia (see FIG. 1) or to U-shaped bracket 24. The design of mounting bracket 14 provides rigidity, strength, and stability for attaching ladder stabilizer 10 to a structure.

Figure 5:
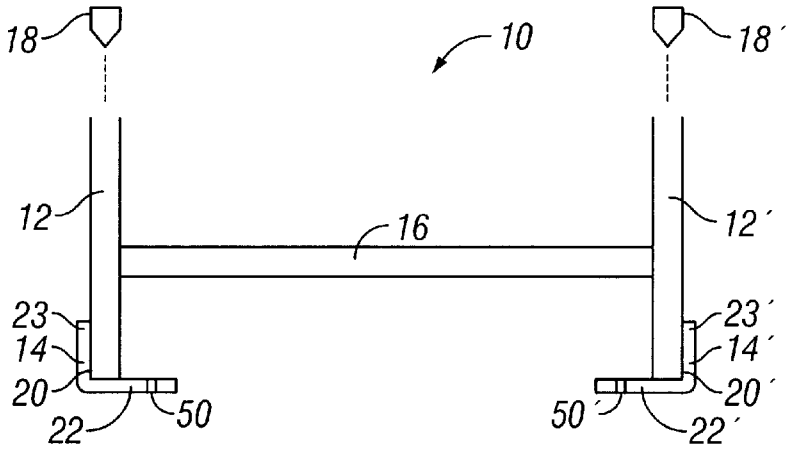
FIG. 5 is a top view of the first embodiment of the ladder stabilizer with the support bar, stops, and mounting bracket components joined with welding joints.
Figure 6:
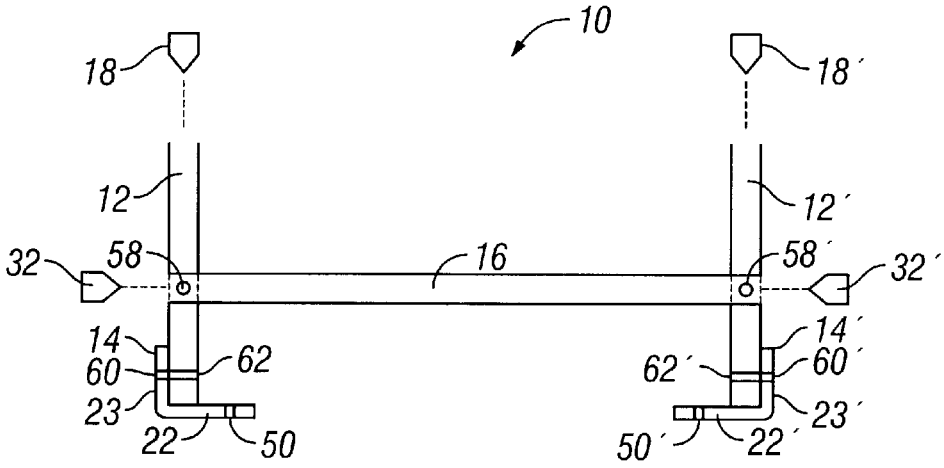
FIG. 6 is a top view of the first embodiment of the ladder stabilizer showing the support bar, stops, and mounting bracket components with openings for fastening means to join the components.
Figure 8:
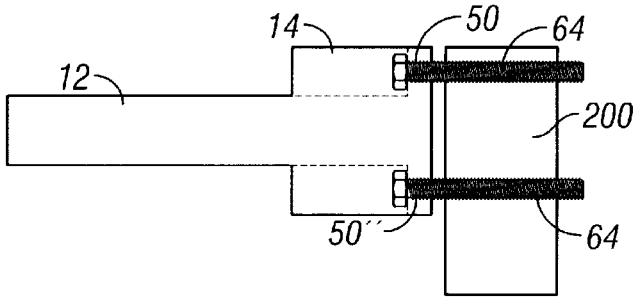
FIG. 8 is a side view of the first embodiment of the ladder stabilizer demonstrating the method of attaching the ladder stabilizer flush to structure fascia.

FIG. 5 is a top view of ladder stabilizer 10 where support bar 16 can be seen positioned between two stops 12 and 12' and affixed to stops 12 and 12' by welding. Mounting brackets 14 and 14' are attached at the end opposite the free end of stops 12 and 12' by welding joints shown generally in the area referred to by 20 and 20'. Optional end caps 18 and 18' fit into the free ends of stops 12 and 12' to close, smooth, and protect the free ends of stops 12 and 12'. End caps 18 and 18' are useful when stops 12 and 12' comprise square tubing. When ladder stabilizer 10 is attached to structure fascia as shown in FIGS. 1 and 8, attachment portions 22 and 22' of mounting brackets 14 and 14' are arranged flush to the structure fascia 200 and mounted to the fascia via fastening means, such as bolts, through openings 50 and 50' in mounting brackets 14 and 14'. While only one opening 50 can be seen in FIG. 5, being a top view, it is to be understood that additional openings for additional fastening means are incorporated into mounting bracket 14. Preferably, at least two fastening means can be used through each mounting bracket for added stability when attaching mounting bracket 14 to structure 200. FIG. 6 is a top view of the ladder stabilizer of FIG. 5 showing additional optional end caps 32 and 32' for closing, smoothing, and protecting the exposed ends of support bar 16 when support bar 16 is affixed to stops 12 and 12' with fastening means, such as shown in FIGS. 3 and 4. FIG. 6 demonstrates openings 58 and 58' for corresponding fastening means to be inserted through to secure support bar 16 to stops 12 and 12'. Openings 60 and 60' on mounting brackets 14 and 14' mate with corresponding openings 62 and 62' on stops 12 and 12' for the insertion of fastening means to affix mounting brackets 14 and 14' to stops 12 and 12'. The fastening means are an alternative manner of attaching brackets 14 and 14' to stops 12 and 12', to welding. It is to be understood that there are a variety of fastening means, including bolts and nuts, rivets and the like, and other techniques besides welding, for affixing support bar 16 to stops 12 and 12' and for attaching mounting brackets 14 and 14' to stops 12 and 12'. Any of these methods can be encompassed in the construction of the present invention and will be understood by those of skill in the art.

When mounting ladder stabilizer 10 directly to a structure fascia, such as shown in FIG. 1, fastening means 64 and 64', shown in FIG. 8, are inserted through openings 50 and 50" (not shown) in mounting portion 22 of each mounting bracket 14 and into structure fascia 200, thereby securing ladder stabilizer to fascia 200. An opening into structure fascia 200 for the fastening means can be created by means such as drilling. Fastening means 64 and 64' are inserted into structure fascia 200 until planar mounting portion 22 of mounting bracket 14 is secured flush to structure fascia 200.

Figure 7:
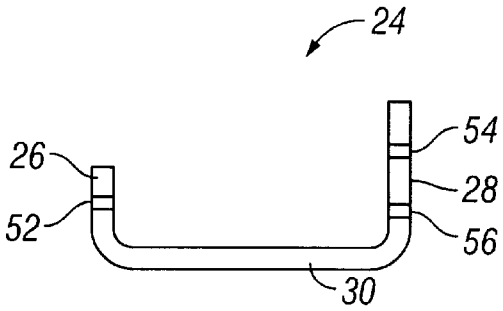
FIG. 7 is a side view of optional U-shaped rain gutter bracket.
Figure 9:
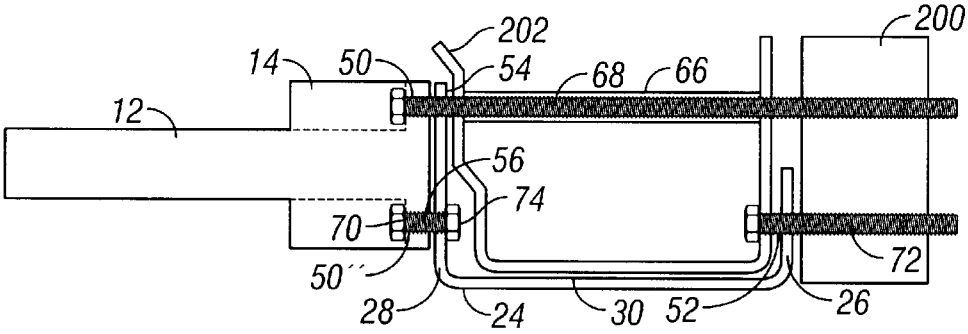
FIG. 9 is a side view of the first embodiment of the ladder stabilizer demonstrating the method of attaching the ladder stabilizer around a rain gutter with U-shaped rain gutter brackets positioned around the underside of the rain gutter.
Figure 10:
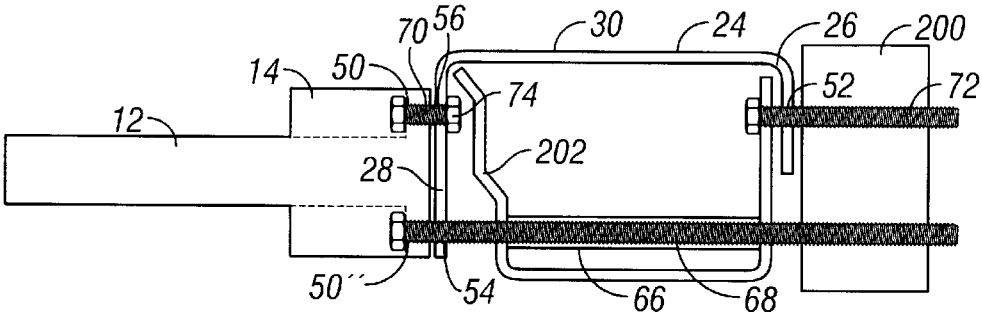
FIG. 10 is a side view of the first embodiment of the ladder stabilizer demonstrating the method of attaching the ladder stabilizer around a rain gutter with U-shaped rain gutter brackets positioned around the topside of the rain gutter.
Figure 11:
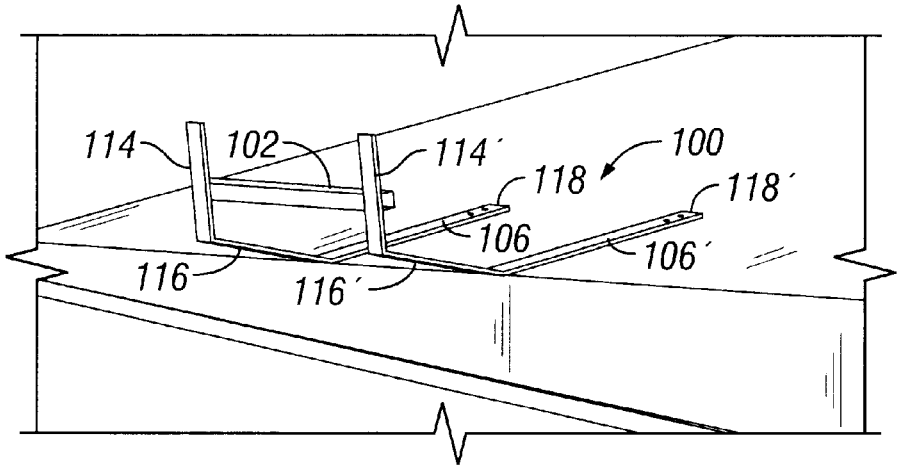
FIG. 11 is a perspective view of a second embodiment of the ladder stabilizer attached to the roof of a structure.
Figure 12:
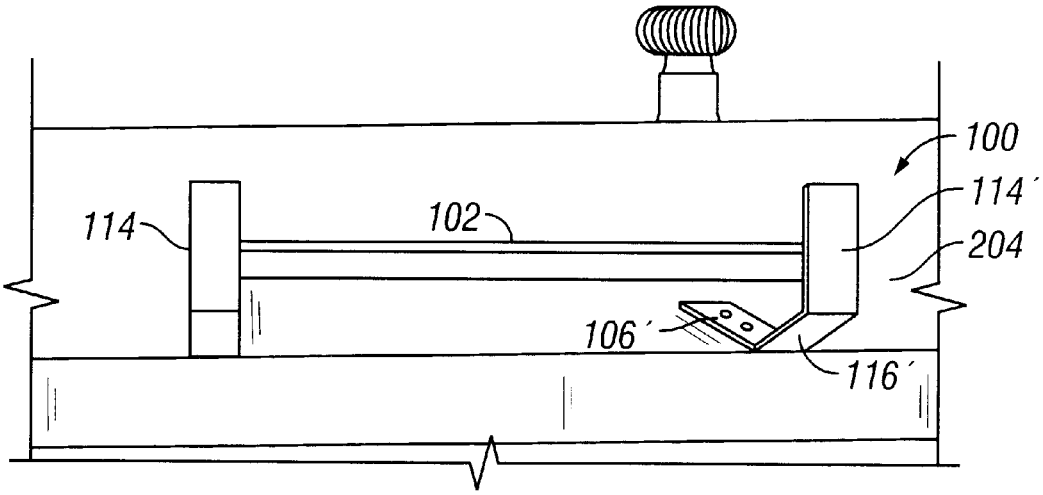
FIG. 12 is another perspective view of the second embodiment of FIG. 12.

When mounting ladder stabilizer 10 around rain gutter 202 as shown in FIGS. 2, 9 and 10, the first embodiment of ladder stabilizer 10 incorporates U-shaped rain gutter brackets 24 and 24' for containing the axial perimeter of a rain gutter. An individual U-shaped bracket 24 is shown in FIG. 7. U-shaped bracket 24 is attached to mounting bracket 14 with fastening means through mating openings 54 in U-shaped bracket 24 and 50 in mounting portion 22 of mounting bracket 14. An additional opening 56 in U-shaped bracket 24 is shown in FIG. 7 to mate with another opening 50" (not shown in FIGS. 5 and 6) in mounting bracket 14 as best seen in FIGS. 9 and 10 to be described below. Depending upon whether U-shaped bracket 24 is mounted over or under a rain gutter, mating openings 54–50 and 56–50" may be exchanged, as discussed with reference to FIGS. 9 and 10. U-shaped bracket 24 is affixed to mounting bracket 14 as shown in FIGS. 2 and 3 by aligning first side portion 28 of bracket 24 with mounting portion 22 of mounting frame 14 such that base portion 30 of bracket 24 is arranged approximately perpendicular to support bar 16 and extends away from ladder stabilizer 10 in approximately the same plane as or parallel to that defined by stop 12 and support bar 16. (See FIG. 3.) Second side portion 26 of bracket 24 is affixed to structure fascia 200 by fastening means inserted through opening 52. This is best demonstrated in FIGS. 9 and 10.

FIG. 9 demonstrates U-shaped rain gutter bracket 24 mounted around and under rain gutter 202 while FIG. 10 demonstrates bracket 24 mounted around and over rain gutter 202. (See also FIG. 2.) Referring first to FIG. 9, a rain gutter 202 is shown affixed to structure fascia 200. Mounting bracket 14 of ladder stabilizer 10 can be seen with openings 50 and 50" for fastening means 70 and 68 which are inserted through corresponding openings 54 and 56 in first side portion 28 of U-shaped bracket 24. Nut 74 secures fastening means 70 to attach mounting bracket 14 securely to U-shaped bracket 24. Fastening means 72 is inserted through rain gutter 202 by available means such as an opening drilled through rain gutter 202 and into structure fascia 200 for securing U-shaped bracket 24 to structure fascia 200. Fastening means 68 is inserted through opening 50 in mounting bracket 14, mating opening 54 in first side portion 28 of U-shaped bracket 24 and is further inserted through rain gutter 202, by available means such as drilled openings, and into structure fascia 200 to further secure U-shaped bracket between mounting bracket 14 and into structure fascia 200. In FIG. 10, U-shaped bracket 24 is shown inverted from the position shown in FIG. 9 so that it is fit around and over the top of rain gutter 202. In this configuration, opening 56 in first side portion 28 of bracket 24 mates with opening 50 in mounting bracket 14 and.opening 54 mates with opening 50" in mounting bracket 14. Fastening means 68, 70, 72 and 74 operate to secure U-shaped bracket 24 to structure fascia 200 in the same manner as described above with reference to FIG. 9. Rain gutter sleeve 66 protects the rain gutter from deformity and serves as a stop for fastening means 68 as it is inserted through rain gutter 202.

Figure 13:
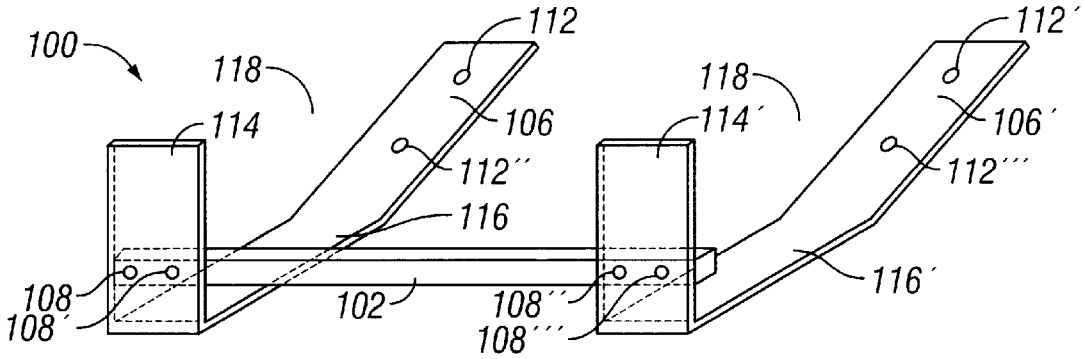
FIG. 13 is a perspective view of the second embodiment of the ladder stabilizer.
Figure 14:
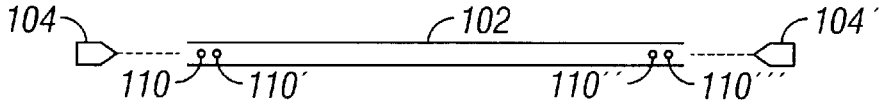
FIG. 14 is a side view of the support bar of the second embodiment of the ladder stabilizer.

Referring to FIGS. 11–14, a second embodiment of ladder stabilizer 100 is shown that can be attached directly to the roof 204 of a structure. Ladder stabilizer 100 extends beyond the roof eave to provide a support bar 102 for a ladder. Ladder stabilizer 100 consists of a pair of support legs 118 and 118' that are preferably planar, or flat, in configuration, each of which are preferably stamped from a single piece of rigid material, such as metal for ease of manufacturing. Each leg 118 is bent at an upward obtuse angle in two locations to create an attachment portion 106 for attaching to a roof, a ramped portion 116, and a stop portion 114. Ladder stabilizer 100 is attached near the eave of roof 204 (see FIGS. 11 and 12) such that ramped portion 116 of each leg 118 extends upward and away from the eave. Preferably the bend location where attachment portion 106 meets ramped portion 116 is positioned at the outer edge of the eave. By attaching ladder stabilizer 100 to roof 204 in this manner, the ladder is supported away from structure fascia, eaves, and rain guttering. The ladder is leaned upon support bar 102 that is affixed to and extends between stops 114 and 114' and is prevented from shifting an excessive distance in either the left or right direction by left and right stops 114 and 114'. Support bar 102 can either be welded directly to stops 114 and 114' or can be affixed by fastening means inserted through corresponding openings 108 and 110 in stops 114 and support bar 102 respectively, such as shown in FIGS. 13 and 14. Optional end caps 104 and 104' are shown in FIG. 14 for closing and smoothing the ends of support bar 102 when support bar 102 comprises square tubing. Support bar 102 is orthogonal to stops 114 and 114' and is positioned at an approximate vertical midpoint of stops 114 and 114'. Ramped portion 116 provides clearance between the ladder and any rain gutter or other surface feature of the structure. Attachment points 112 are shown on attachment portions 106 of legs 118 for fastening means to be inserted through and into the roof 204, thereby securing ladder stabilizer 100 to roof 204.

In the first embodiment, support bar 16 and stops 12 and 12' are made of a sufficiently rigid and strong material, such as one inch square tubing; however, it is to be understood that a variety of materials and sizes of pieces can be used to construct ladder stabilizer 10 in accordance with the principals of the invention. Mounting brackets 14 and 14' can comprise ⅛" angle iron, however, a variety of materials are also sufficient to form mounting brackets 14 and 14'. Approximately U-shaped brackets 24 can comprise ⅜" flat steel or any sufficiently rigid material. In the second embodiment, support legs 118 can comprise 2"×8" flat metal or other sufficiently rigid and strong material and support bar 102 can comprise 1" square tubing. Fastening means for attaching mounting bracket 14 directly to a surface of the structure can comprise four lag bolts, two for each mounting bracket, inserted through openings 50 in mounting bracket 14 and into drilled openings in structure fascia until ladder stabilizer 10 is secure. Fastening means for attaching mounting bracket 14 and U-shaped bracket 24 to a structure surface, can also comprise lag bolts inserted through the openings as described above with reference to FIGS. 9 and 10. Any openings drilled into the rain gutter, are preferably sealed around the fastening means.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A ladder stabilizer for supporting a ladder against a structure, said stabilizer comprising:

two lateral translation stops for preventing lateral movement of the ladder beyond said stops, each of said stops comprising a planar rear mounting portion for attachment to a bracket, the plane of said rear mounting portion disposed orthogonally to said stop;

a support bar affixed to and extending between said two stops for supporting an end of the ladder; and two approximately U-shaped brackets, each of said brackets comprising a planar base portion, a first planar side portion, and a second planar side portion, said first planar side portion attached to said planar rear mounting portion of said stop such that said first planar side portion is disposed in parallel planar relation to said planar rear mounting portion, said second planar side portion for attachment to the structure and disposed in parallel planar relation to said first planar side portion, and said planar base portion connecting said first planar side portion to said second planar side portion, said planar base portion of a length adapted to be greater than the width of a structure rain gutter.

2. The ladder stabilizer of claim 1 wherein said stops are adapted for placement of the rails of a ladder between the inner surfaces of said stops.

3. The ladder stabilizer of claim 1 wherein said first side portion defines at least one opening in said first side portion through which fastening means can be inserted to attach said U-shaped bracket to said first side portion.

4. The ladder stabilizer of claim 1 wherein said second side portion defines at least one opening in said second side portion through which fastening means can be inserted, said fastening means adapted to attach said U-shaped bracket to a structure surface.

5. A ladder stabilizer for supporting a ladder against a structure, said stabilizer comprising:

two support legs for attaching said stabilizer to a structure and for supporting a ladder, each of said support legs comprising:

an attachment portion for attaching said leg to the roof of the structure;

a ramped portion extending at an obtuse angle from said attachment portion; and a stop portion extending at an obtuse angle from said ramped portion for preventing lateral movement of a ladder rail beyond said stop portion, said attachment portion, said ramped portion, and said stop portion together forming an integral leg bent upward at two locations to form said ramped portion and said stop portion; and a support bar affixed to and extending between said support leg stop portions for supporting an end of the ladder.

6. The ladder stabilizer of claim 5 wherein said attachment portion defines at least one opening in said attachment portion through which fastening means are insertable to attach said attachment portion to the roof of a structure.

7. The ladder stabilizer of claim 5 further comprising fastening means for attaching said attachment portions of said support legs to the roof of a structure.

8. A ladder stabilizer for supporting a ladder against roof fascia of a structure, said stabilizer comprising:

two lateral translation stops for preventing lateral movement of the ladder beyond said stops;

a support bar affixed to and extending between said two stops for supporting an end of the ladder; and two mounting brackets attached to said two stops, each of said mounting brackets comprising:

a planar side portion attached to a surface of one of said stops; and a planar rear mounting portion orthogonal to said planar side portion for attaching said stabilizer to roof fascia of a structure, said planar side portion and said planar rear mounting portion together forming an L-shaped mounting bracket.

* * * * *